US008893724B2

(12) United States Patent
Woodcock et al.

(10) Patent No.: US 8,893,724 B2
(45) Date of Patent: Nov. 25, 2014

(54) CONTROL OF PUFF PROFILE

(75) Inventors: Dominic Woodcock, London (GB); James Murphy, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/502,331

(22) PCT Filed: Oct. 15, 2010

(86) PCT No.: PCT/GB2010/051738

§ 371 (c)(1), (2), (4) Date: Aug. 3, 2012

(87) PCT Pub. No.: WO2011/045609

PCT Pub. Date: Apr. 21, 2011

(65) Prior Publication Data

US 2012/0298123 A1 Nov. 29, 2012

(30) Foreign Application Priority Data

Oct. 16, 2009 (GB) ..... 0918129.8

(51) Int. Cl.

*A24F 47/00* (2006.01)
*A24B 15/16* (2006.01)
*A24B 15/28* (2006.01)

(52) U.S. Cl.

CPC ..... *A24B 15/165* (2013.01); *A24F 47/004* (2013.01); *A24B 15/283* (2013.01)
USPC ..... 131/194; 131/270

(58) Field of Classification Search

USPC ..... 131/270–273, 194
See application file for complete search history.

(56) References Cited

U.S. PATENT DOCUMENTS

| | | | | | |
|---|---|---|---|---|---|
| 4,893,639 | A | * | 1/1990 | White | 131/369 |
| 4,967,772 | A | * | 11/1990 | Waddell et al. | 131/334 |
| 5,019,122 | A | * | 5/1991 | Clearman et al. | 131/194 |
| 5,099,861 | A | | 3/1992 | Clearman et al. | |
| 2005/0000531 | A1 | | 1/2005 | Shi | |
| 2007/0215167 | A1 | | 9/2007 | Llewellyn Crooks et al. | |
| 2008/0163877 | A1 | | 7/2008 | Zhuang et al. | |

FOREIGN PATENT DOCUMENTS

| | | | |
|---|---|---|---|
| EP | 1889550 | B1 | 7/2009 |
| WO | 2004041007 | A2 | 5/2004 |
| WO | 2005053444 | A1 | 6/2005 |
| WO | 2010//125385 | A1 | 11/2010 |

OTHER PUBLICATIONS

International Preliminary Report on Patentability, mailed Apr. 3, 2012, for PCT International Application No. PCT/GB2010/051738, filed Oct. 15, 2010.

(Continued)

*Primary Examiner* — Richard Crispino
*Assistant Examiner* — Dionne Walls Mayes
(74) *Attorney, Agent, or Firm* — NW Poulsen; X Kong

(57) ABSTRACT

The invention relates to heat not burn products comprising an encapsulated aerosol generating agent, the encapsulation having the effect of controlling the release of the agent during use of the heat not burn product. The encapsulation will control the timing of the release of the aerosol generating agent during the use of the heat not burn product, to allow greater control of the puff yield. In the case of some aerosol generating agents, the encapsulation may also increase the stability of the agent and/or prevent its migration within the product.

20 Claims, 2 Drawing Sheets

(56) References Cited

OTHER PUBLICATIONS

International Search Report and Written Opinion, mailed Feb. 3, 2011, for PCT International Application No. PCT/GB2010/051738, filed Oct. 15, 2010.
Written Opinion, mailed Feb. 16, 2012, for PCT International Application No. PCT/GB2010/051738, filed Oct. 15, 2010.
Communication Of A Notice Of Opposition, mailed Sep. 12, 2014, for European Patent Application No. 10768538.0.
Voges, Ernst et al., "Tabaklexikon" Mainz: Mainzer Verlagsanstalt and Druckerei Will and Rothe KG, 1967, mailed Sep. 12, 2014, for European Patent Application No. 10768538.0.

* cited by examiner

CONTROL OF PUFF PROFILE

CLAIM FOR PRIORITY

This application is a National Stage Entry entitled to and hereby claims priority under 35 U.S.C. §§365 and 371 to corresponding PCT Application No. PCT/GB2010/051738, filed Oct. 15, 2010, which in turn claims priority to British Application Serial No. GB 0918129.8, filed Oct. 16, 2009. The entire contents of the aforementioned applications are herein expressly incorporated by reference.

FIELD OF THE INVENTION

The present invention relates to encapsulated diluents for inclusion in "heat not burn" products.

BACKGROUND

Heat not burn products, which are sometimes also referred to as non-combustion type smoking articles, are being developed as a possible alternative to conventional smoking articles such as cigarettes. The basic principle is that the product heats tobacco to cause the volatilisation of the low boiling point components but avoiding pyrolysis or combustion of the tobacco or volatiles (although some charring of the tobacco can occur during normal usage). This volatilisation leads to the creation of a vapour which is drawn through the product and is then condensed into an aerosol and inhaled by the user. The volatilised components include water, nicotine, humectants and light volatiles.

The present invention relates in particular to those heat not burn products which include a heat source and an aerosol generating portion, such as a tobacco rod, from which certain components are vaporised during use. In such products the heat source may be a solid extrusion moulded article of a carbonaceous material which is lit to provide the heat for volatilisation and, following lighting, continues to smoulder and generate heat. In order to avoid burning on contact with the lit heat source, this part of the product may be surrounded by a non-flammable material such as fibreglass, a paper sheet containing glass fibres, a ceramic, or a paper sheet internally lined with a metal foil. The heat not burn products also include an aerosol-generating portion adjacent to the heat source. This portion generally has a cylindrical body similar in external appearance to the tobacco rod of a conventional cigarette. It includes components which are to be volatilised during use. This portion may include tobacco and will often comprise distinct sections having different functions, including a vaporisation chamber (for example comprising tobacco and an aerosol generating agent) adjacent to the heat source, and a cooling chamber (for example comprising shredded reconstituted tobacco sheet) further downstream towards the mouth end of the product. A filter or mouthpiece is usually situated at the mouth end of the product and this may comprise, for example, cellulose acetate.

These heat not burn products include aerosol generating agents such as propylene glycol (PG) and glycerol.

One of the primary aims of the heat not burn products is to earn consumer acceptance as an alternative to conventional smoking articles. One approach to achieving this acceptance will depend upon the heat not burn product producing a similar experience to the smoking articles (although it is recognised that it may also or alternatively be possible to achieve acceptance by other means).

An aspect of the experience of smoking a conventional smoking article is the so-called "puff profile", also referred to as the "puff per puff profile". This is the amount of total particulate matter yield (mg/cig) in each puff as the smoking article is consumed. The total particulate matter (TPM) delivery of a conventional cigarette is relatively low during the first couple of puffs, but it tends to gradually increase right through to the final puffs. This gives the smoker the sensation of the smoke gradually increasing in strength.

In contrast, for heat not burn products, the puff profile tends to start very weakly before rapidly increasing within the first few puffs. The TPM delivery then decreases until the product is consumed. This is mainly because these products take a few puffs to reach an optimum temperature, after which they give a high yield of aerosol. However, the puff yield can rapidly diminish during usage as the available aerosol generating agent, such as PG, is boiled off and used up. As a result, such heat not burn products are known to have the disadvantage that they tend to have diminished sensory properties towards the end of the product when compared with a conventional cigarette (see FIG. 1).

It is therefore an aim of the present invention to modify the puff profile of heat not burn products, for example, so as to produce a profile which more closely resembles that of a conventional smoking article.

It has been discovered that, although the aerosol generating agents are vaporised during use of the heat not burn product, vaporisation of some agents at lower temperatures can cause problems during storage of the products. Specifically, some aerosol generating agents can migrate during storage and subsequently be lost to the atmosphere or interact with other parts of the product such as the surrounding paper wrapper. This may also lead to staining or marking of the product, either by the agent itself or by compounds released from the agent interaction. It is therefore desirable to immobilize the aerosol generating agent within the heat not burn product until it is required.

Furthermore, when aerosol generating agents are included in heat not burn products, there is currently no way of controlling their vaporisation and therefore their effect on the puff profile of the product.

The present invention seeks to improve the performance of heat not burn products and overcome the aforementioned problems by controlling the release of aerosol generating agents.

SUMMARY OF THE INVENTION

According to a first aspect of the present invention there is provided a heat not burn product comprising an encapsulated aerosol generating agent.

According to a second aspect of the present invention, there is provided the use of an encapsulated aerosol generating agent in a heat not burn product in order to control the puff profile of the product.

DETAILED DESCRIPTION

Figure 1:
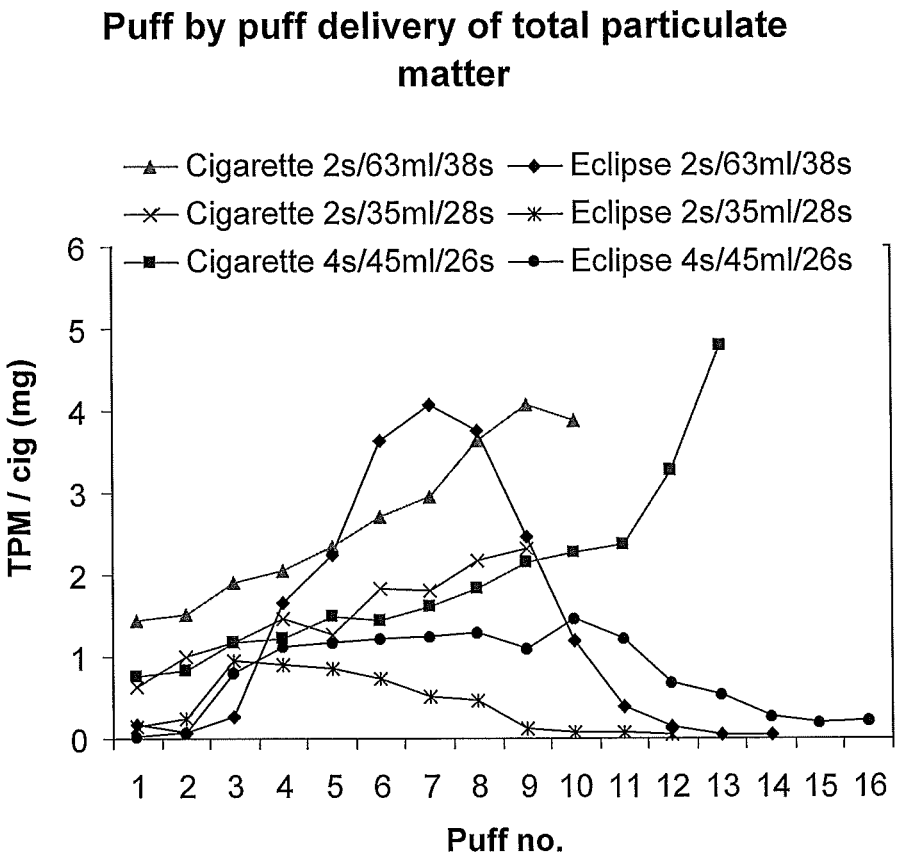
FIG. 1 is graph showing the puff by puff delivery of total particulate matter of a cigarette compared to that of an Eclipse® (R. J. Reynolds) heat not burn product, both under three different smoking regimes.

The heat not burn products according to the invention comprise an encapsulated aerosol generating agent, the encapsulation having the effect of controlling the release of the agent during use of the heat not burn product. In a preferred embodiment, the encapsulation will control the timing of the release of the aerosol generating agent during the use of the heat not burn product, to ensure a gradual and sustained release of the aerosol generating agent and thereby allow greater control of the puff yield. In the case of some aerosol generating agents, the encapsulation may also increase the stability of the agent and/or prevent its migration within the product.

The aerosol generating agent is a substance which generates an aerosol upon heating. The aerosol generating agent may be, for instance, a polyol aerosol generator or a non-polyol aerosol generator. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol generating agents. A combination of aerosol generating agents may be used, in equal or differing proportions. Polyethylene glycol and glycerol may be particularly preferred, whilst triacetin is more difficult to stabilise and also needs to be encapsulated in order to prevent its migration within the product.

There may be several factors influencing the stability and migration of aerosol generating agents under ambient conditions. These factors may include hydrophobicity or hydrophilicity, viscosity, saturated vapour pressure at room temperature, boiling point, molecular structure (such as hydrogen bonding or Van der Waals forces) and the absorptive/adsorptive interaction between the aerosol generating agent and the substrate. Some aerosol generating agents will suffer from migration problems to a greater extent than others; for instance, it has been found that triacetin, isopropyl myristate and triethyl citrate are particularly prone to migration and therefore benefit from immobilisation by encapsulation according to the present invention.

Another relevant factor is the loading level of the aerosol generating agent. For instance, if an aerosol generating agent such as glycerol is included in a large amount, migration problems can still be significant.

The aerosol generating agent loading level in the present invention may depend upon the specific agent. The aerosol generating agent may be included in an amount of up to 95% of the weight of the aerosol generating portion.

The product may also contain non-encapsulated aerosol generating agents, however, such unencapsulated aerosol generating agents are preferably only ones that are stable during storage, such as glycerol.

The encapsulated aerosol generating agent is encapsulated in a barrier material, which not only provides hindrance to migration during storage of the heat not burn product but allows controlled release of the agent during use.

The barrier material (also referred to herein as the encapsulating material) may be one that melts, decomposes, reacts, degrades, swells or deforms to release the aerosol generating agent at a temperature above room temperature but at or below the temperature reached inside the heat not burn product during use. In embodiments of the invention, the barrier material releases substantial amounts of the aerosol generating agent above 50° C., preferably above 60° C., 70° C., 80° C. or 90° C. The time taken for the aerosol generating agent to be released may be further controlled by the thickness of the barrier material.

The barrier material may be, for example, a polysaccharide or cellulosic barrier material, a gelatin, a gum, a gel, a wax or a mixture thereof. Suitable polysaccharides include alginate, dextran, maltodextrin, cyclodextrin and pectin. Suitable cellulosic materials include methyl cellulose, ethyl cellulose, hydroxyethyl cellulose, hydroxypropyl cellulose, carboxymethyl cellulose, and cellulose ethers. Suitable gums include gum Arabic, gum ghatti, gum tragacanth, Karaya, locust bean, acacia gum, guar, quince seed and xanthan gums. Suitable gels include agar, agarose, carrageenans, furoidan and furcellaran. Suitable waxes include carnauba wax.

In a preferred embodiment of the invention, the barrier material comprises a polysaccharide. An alginate is especially preferred, due to its encapsulation properties. The alginate may be, for instance, a salt of alginic acid, an esterified alginate or glyceryl alginate. Salts of alginic acid include ammonium alginate, triethanolamine alginate, and group I or II metal ion alginates like sodium, potassium, calcium and magnesium alginate. Esterified alginates include propylene glycol alginate and glyceryl alginate.

In an embodiment, the barrier material is sodium alginate and/or calcium alginate. Calcium alginate provides a greater inhibition of migration of the aerosol generating agent at ambient temperature than sodium alginate, but also may release the aerosol generating agent at a higher temperature than the latter.

In another embodiment of the invention, acacia gum is provided as the barrier material for encapsulating triacetin.

In some embodiments, the encapsulated aerosol generating agent may be encapsulated using two or more encapsulating materials, for example in separate layers.

In order to provide the desired timing of the release of the aerosol generating agent, different encapsulation materials may be used or different encapsulation approaches. For example, in order to provide instant release of aerosol generating agent upon lighting of the heat not burn product, the aerosol generating portion may include a stable aerosol generating agent, such as glycerol, in non-encapsulated form, applied directly to the tobacco. For release shortly thereafter, aerosol generating agent may be provided which is encapsulated using a barrier material with a relatively low melting point, a thin barrier layer, and/or a barrier created by mixing the barrier material with which the aerosol generating agent, to provide prompt release as the temperature in the aerosol generating portion of the product starts to rise. Finally, further aerosol generating agent may be provided for delayed release and this agent can be encapsulated using a barrier material with a relatively high melting point, or a relatively thick barrier layer, and/or the aerosol generating agent is completely surrounded by the barrier material to delay release until the barrier has been properly compromised.

In some embodiments of the invention, the barrier material is applied to particulate carrier material (such as a particulate sorbent material) carrying the aerosol generating agent. This application of the barrier material may be carried out by any suitable method known to the skilled person or described herein, which does not cause complete loss of the aerosol generating agent in the process. Such methods include, for example, spray drying, coextrusion, pilling, etc. Preferably, substantially no aerosol generating agent is lost due to the step of applying the barrier material. In an embodiment, the barrier material or a precursor thereto is sprayed onto the particulate carrier material.

For instance, the particulate carrier material carrying the aerosol generating agent can be sprayed with an aqueous sodium alginate solution and dried to form a water-soluble film of sodium alginate on the surface. Alternatively, the particulate material can be sprayed with sodium alginate and then treated with a source of calcium ions, to form a water-insoluble film or gel covering of calcium alginate. In some embodiments, the calcium ions may already be naturally present.

In the resulting product, individual aerosol generating agent-carrying particles may be surrounded by barrier material and migration of the agent is further hindered under ambient conditions. Alternatively, the agent may combined with barrier material before application to the carrier, such that in the resulting product the barrier material resides in homogeneous admixture with the agent. In a yet further alternative, the agent may be pre-encapsulated with the barrier material before application to the carrier (and so is not in intimate contact with the carrier). One or any combination of these approaches may be used in the present invention.

In a particularly preferred embodiment, the barrier material used to encapsulate the aerosol generating agent releases the aerosol generating agent in a temperature-dependent manner. This may be achieved by using a barrier material which has a melting point which is such that the encapsulated agent will be released when it is exposed to a given temperature during normal use of the heat not burn product.

In order to provide control of the release of the aerosol generating agent over the whole period of the use of the heat not burn product, the encapsulated aerosol generating agent will preferably gradually release the aerosol generating agent, rather than allowing all of the agent to be released at the same time. In one embodiment of the invention, this is achieved by using more than one barrier material, the materials having different melting points. Capsules made from material with the lower melting points will release their aerosol generating agent before the capsules made from material with higher melting points. In another embodiment, the barrier material is used to form capsules with different wall thicknesses, the thicker walls taking longer to melt and release the aerosol generating agent than thinner walls. In such an embodiment, one or more different encapsulating materials may be used. In a yet further embodiment, the positioning of the encapsulated aerosol generating agent within the product may help to control the timing of release, especially where there tends to be a temperature gradient along the length of the heat not burn product. Positioning the encapsulated agent along the length of the tobacco rod of the product may allow the timing of the release of the aerosol generating agent to be controlled, with the release being spread over the whole period of use of the product, the encapsulated agent positioned closer to the heat source being released first and that positioned closest to the mouth end of the product being released later.

In a different approach, the encapsulating material is frangible and the release of the aerosol generating agent is manually controlled by the consumer who must crush and rupture one or more capsules to enhance the yield. This gives the consumer control over the puff profile of the product.

This use of encapsulated aerosol generating agent in a heat not burn product can be used to achieve any desired puff profile as measured on a smoke engine. Thus, the heat not burn product could be designed to mimic the profile of a conventional cigarette, with a gradual increase in the yield with every puff. Alternatively, the puff profile could be designed to be much flatter, with a consistent yield throughout the consumption of the product.

In some embodiments of the invention, further components may be encapsulated together with the aerosol generating agent, for example other diluents and/or flavourants. Such further components may also or alternatively be included in the heat not burn product in separate capsules.

The inclusion of flavourants which are released together with the aerosol generating agent may be particularly attractive, as the perception of a reduction in flavour by the user will accompany a reduction in the aerosol generating agent being released, which in turn indicates that the product is finished.

In preferred embodiments of the present invention, the heat not burn product comprises a heat source and an aerosol generating portion which made up of discrete sections comprising tobacco. In some embodiments, the discrete sections include different amounts of encapsulated aerosol generating agent or different types of encapsulated aerosol generating agent. For example, more encapsulated material may be present in sections closer to the mouth end of the product than those closer to the heat source. Alternatively, the nature of the aerosol generating agent and/or or the nature of the barrier material may differ in the different sections of the aerosol generating portion of the product, in order to contribute to the control of the release of the aerosol generating agent during use of the product.

Migration of the aerosol generating agent between different parts of the heat not burn product (for example, between adjacent tobacco sections) will to be avoided by encapsulation and this will help to ensure that the product produces predictable and reproducible results, even when relatively unstable aerosol generating agents, such as triacetin, are used.

Although the foregoing detailed description focuses on the inclusion of the encapsulated aerosol generating agent in a particular type of heat not burn product, it is suitable for inclusion in other types of heat not burn products.

EXAMPLES

Triacetin (a compound widely understood to be a smoke diluent) was encapsulated in acacia gum a using a spray drying technique to give a fine powder with a mean particle size ($D_v$) of 53 μm. The resulting capsules were further coated with low viscosity sodium alginate using a fluidised bed technique. The particles were then treated with calcium chloride to crosslink the alginate and improve its barrier properties. The resulting capsules had a mean particle size ($D_v$) of 610 μm, a tapped density of 410 g/litre and a triacetin content of 17.0% by weight. These capsules were designated as capsule 1.

A second batch of encapsulated triacetin was made using a different method. Triacetin was encapsulated in carnauba wax using a spray chilling (prilling) technique. The resulting capsules had a mean particle size ($D_v$) of 438 μm and a triacetin content of 20.4% by weight. These capsules were designated as capsule 2.

Eclipse cigarettes (by RJ Reynolds Tobacco) are "heat-not-burn" products that use the heat from the combustion of a plug of carbon to vapourise a smoke diluent (glycerol) to form a smoke-like aerosol for inhalation. There are two distinct types of tobacco in Eclipse cigarettes; a section containing high levels of diluent close to the combustible carbon at the lit end and a second section at the mouth end that does not contain the diluent. A large percentage of the smoke from Eclipse cigarettes is made up of glycerol.

Using Eclipse cigarettes, a window was cut through the tobacco wrapper into the front tobacco section (nearest to the lit end) and approximately 130 mg of tobacco was removed. The tobacco was replaced with approximately 235 mg of capsule 1. The window in the tobacco wrapper was then closed by folding back the tobacco wrapper and the incision sealed using glue and a conventional cigarette paper. A second window was cut through the tobacco wrapper into the rear tobacco section (nearest to the mouth end) and approximately 150 mg of tobacco was removed. The tobacco was replaced with approximately 196 mg of capsule 6. The window in the tobacco wrapper was then closed by folding back the tobacco wrapper and the incision sealed using glue and a conventional cigarette paper.

15 cigarettes were prepared with capsules and were smoked on a Botgwaldt RM20D smoking engine under and intense smoking regime (a 55 mL puff of 2 second duration, every 30 seconds with the tip ventilation blocked). Total particulate matter was collected on Cambridge Filter Pads on a puff by puff basis. The filter pads were analysed for triacetin.

For comparison, unmodified Eclipse cigarettes were smoked under the same regime on a puff by puff basis and the filter pads analysed for glycerol.

Figure 2:
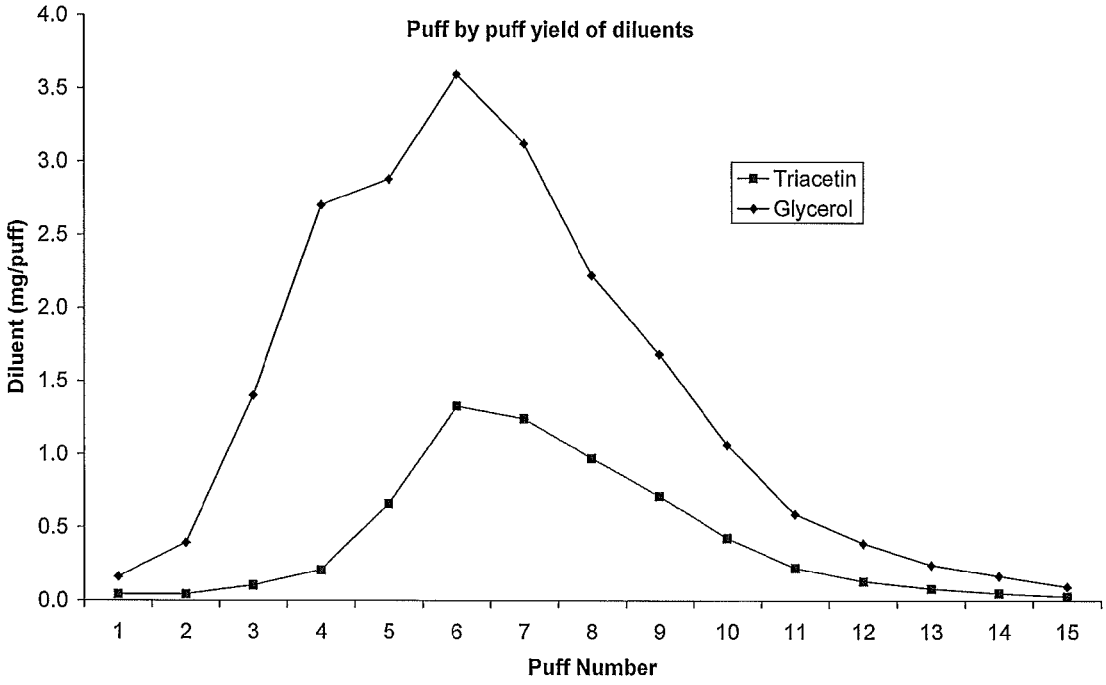
FIG. 2 is graph showing the puff by puff delivery of diluent of a cigarette compared to that of an Eclipse® (R. J. Reynolds) heat not burn product.

The results (shown in FIG. 2) indicate that glycerol from the unmodified control cigarette enters the mainstream smoke from puff one and rapidly increases after puff two. In contrast, the encapsulated triacetin does not enter the mainstream smoke in substantial quantities until puff four and the rate of release to the smoke is lower when compared with glycerol. This demonstrates a controlled release of diluent to the mainstream smoke.

The invention claimed is:

1. A heat not burn product comprising an encapsulated aerosol generating agent, wherein release of the aerosol generating agent during use is controlled using different encapsulation materials or different encapsulation approaches to produce a desired puff yield of total particulate matter, the aerosol generating agent being encapsulated using at least two different barrier materials, the at least two different barrier materials having different melting points, the aerosol generating agent being carried by a particulate carrier material, and the at least two different barrier materials being applied to the particulate carrier material carrying the aerosol generating agent.

2. The heat not burn product as claimed in claim 1, wherein the aerosol generating agent is encapsulated using different thicknesses of the at least two different barrier materials, the thickness of the at least two different barrier materials determining when the aerosol generating agent is released during use.

3. The heat not burn product as claimed in claim 1, wherein the distribution of the encapsulated aerosol generating agent controls the timing of the release of the aerosol generating agent during use.

4. The heat not burn product as claimed in claim 1, wherein the aerosol generating agent is a polyol.

5. The heat not burn product as claimed in claim 4, wherein the polyol is at least one of: sorbitol, glycerol, or glycols.

6. The heat not burn product as claimed in claim 5, wherein the glycol is at least one of propylene glycol or triethylene glycol.

7. The heat not burn product as claimed in claim 1, wherein the at least two different barrier materials are at least one of: a polysaccharide; a cellulosic barrier material; a gelatine; a gum; or a gel.

8. The heat not burn product as claimed in claim 7 wherein the polysaccarade is at least one of alginate, dextran, maltodextrin, cyclodextrin or pectin.

9. The heat not burn product as claimed in claim 7, wherein the cellulosic barrier material is at least one of methyl cellulose, ethyl cellulose, hydroxyethyl cellulose, hydroxypropyl cellulose, carboxymethyl cellulose, or cellulose ethers.

10. The heat not burn product as claimed in claim 7, wherein the gum is at least one of gum Arabic, gum ghatti, gum tragacanth, Karaya, locust bean, acacia, guar, quince seed or xanthan gums.

11. The heat not burn product as claimed in claim 7, where in the gel is at least one of agar, agarose, carrageenans, furoidan or furcellaran.

12. The heat not burn product as claimed in claim 1, wherein the aerosol generating agent is released during use so that it is configured to provide a substantially constant delivery of total particulate matter per puff.

13. The heat not burn product as claimed in claim 1, wherein the aerosol generating agent is released during use so that it is configured to provide a gradually increasing delivery of total particulate matter per puff.

14. The heat not burn product as claimed in claim 1 wherein the aerosol generating agent is a non-polyol.

15. The heat not burn product as claimed in claim 14, wherein the non-polyol is at least one of monohydric alcohols, high boiling point hydrocarbons, acids, esters, or aliphatic carboxylic acid esters.

16. The heat not burn product as claimed in claim 15, wherein the acid is lactic acid.

17. The heat not burn product as claimed in claim 15, wherein the esters are at least one of diacetin, triacetin, triethyl citrate or isopropyl myristate.

18. The heat not burn product as claimed in claim 15, wherein the aliphatic carboxylic acid esters are at least one of methyl stearate, dimethyl dodecanedioate or dimethyl tetradecanedioate.

19. The heat not burn product as claimed in claim 1, wherein the puff yield of total particulate matter of the heat not burn product resembles a conventional smoking article.

20. A method for controlling the release of an aerosol generating agent in a heat not burn product, so as to produce a desired puff yield of total particulate matter, comprising:

encapsulating an aerosol generating agent using different encapsulation materials or different encapsulation approaches, and at least two different barrier materials, the at least two different barrier materials having different melting points, the aerosol generating agent being carried by a particulate carrier material; and applying the at least two different barrier materials to the particulate carrier material carrying the aerosol generating agent.

* * * * *